US005931237A

United States Patent [19]

Henke et al.

[11] Patent Number: 5,931,237

[45] Date of Patent: Aug. 3, 1999

[54] SOIL TESTING ASSEMBLIES

[75] Inventors: Robert Henke; Wanda Henke, both of Lutherville; Malcolm C. Minor, Upper Marlboro, all of Md.

[73] Assignee: Dynamic In Situ Geotechnical Testing, Inc., Lutherville, Md.

[21] Appl. No.: 08/877,600

[22] Filed: Jun. 18, 1997

Related U.S. Application Data

[60] Provisional application No. 60/020,228, Jun. 18, 1996.

[51] Int. Cl.[6] ..... E21B 49/00

[52] U.S. Cl. ..... 175/50; 73/84; 73/784; 166/212; 166/250.01; 175/58

[58] Field of Search ..... 166/212, 250.01; 175/58, 20, 246, 236, 50; 73/84, 864.43, 864.44, 85

[56] References Cited

U.S. PATENT DOCUMENTS

| | | | |
|---|---|---|---|
| 2,681,112 | 6/1954 | Lee | 166/134 |
| 2,792,063 | 5/1957 | Jones | 166/212 |
| 3,346,059 | 10/1967 | Svendsen | 175/246 |
| 3,427,871 | 2/1969 | Handy et al. | 73/84 |
| 4,081,040 | 3/1978 | Henson | 175/58 |
| 4,400,970 | 8/1983 | Ali | 73/84 |
| 4,539,851 | 9/1985 | Lutenegger | 73/84 |
| 4,744,438 | 5/1988 | Ruzie et al. | 166/212 |
| 5,105,881 | 4/1992 | Thoms et al. | 166/250.01 |
| 5,127,261 | 7/1992 | Ingram et al. | 73/864.45 |
| 5,203,824 | 4/1993 | Henke et al. | 73/864.43 |
| 5,379,838 | 1/1995 | Wilson et al. | 166/212 |
| 5,450,913 | 9/1995 | Mefferd et al. | 175/58 |
| 5,482,123 | 1/1996 | Collee | 175/58 |

*Primary Examiner*—Hoang C. Dang
*Attorney, Agent, or Firm*—Trop, Pruner, Hu & Miles, P.C.

[57] ABSTRACT

An apparatus for securing a soil testing device and other attachments necessary for soil testing near the bottom of a borehole uses a pair of clamps with gripping teeth that interlock with similar gripping teeth in the internal wall of the auger. The lateral movements of the clamps toward the auger are controlled so that the soil testing device is maintained in a proper orientation with respect to the soil sample and to avoid uncontrolled engagements of the clamps with the auger.

12 Claims, 4 Drawing Sheets

SOIL TESTING ASSEMBLIES

CROSS REFERENCE TO RELATED APPLICATIONS

This application is based on provisional application Ser. No. 60/020,228, filed Jun. 18, 1996.

FIELD OF THE INVENTION

This invention relates generally to techniques for testing soil, and particularly, to clamping assemblies for securing soil testing devices in a borehole.

BACKGROUND OF THE INVENTION

It is often important to determine properties such as the resistance of a soil to liquefaction, the degradation characteristics of a soil, the dynamic shear modulus of a soil at low levels of shear deformation, and the variation in the shear modulus of a soil with shear deformation. Commonly, these soil properties, as well as others, are necessary for the analysis which predicts the response of a site or foundation structure system to dynamic loading caused by earthquakes, ocean waves, or mechanical vibrations.

Soil properties may be determined by in situ field tests. For example, the liquefaction resistance of a soil may be determined by a penetration test that involves penetrating a closed ended probe into the ground at a slow, controlled rate or driving a cylinder into the ground by violent impacts. The resistance of the soil to liquefaction is correlated to the resistance of the probe or cylinder to penetration. A technique that can measure the resistance of a soil to liquefaction by torsionally exciting the soil is disclosed in the U.S. Pat. Nos. 4,594,899 and 5,203,824 to Robert Henke and Wanda Henke. In these patents, the illustrated testing device includes a pair of concentric open ended cylinders that are inserted into the soil to be tested. A torque may be applied to the inner cylinder and the response of the cylinder and the soil to the applied torque may be measured by sensors mounted on the inner cylinder.

In such soil tests a borehole is drilled to access the soil sample and the testing device is lowered down the borehole to test the soil. The testing device may be secured to an auger in the borehole. The test device may be subjected to substantial applied forces or torques or other reaction forces from the soil. Thus the auger to which the testing device is anchored may serve as a reaction means to carry out various operations on the testing device.

If the testing device is not properly secured to the auger, the testing device may slip from the auger as a result of the reaction forces produced by the applied forces or torques on the testing device. There is a need for a device that better secures the testing device to the auger.

The testing device should maintain a correct orientation with respect to the soil sample, even when the testing device is subjected to applied forces or torques. This is because improper orientation of the testing device may cause inaccuracies in test results or damage to the testing device.

SUMMARY OF THE INVENTION

In accordance with one aspect of the present invention, a soil testing device insertable into a borehole, includes a first external cylinder. A soil testing device is located inside the cylinder. A clamping element is connected to the soil testing device. The clamping device is arranged to extend laterally outwardly to engage said cylinder. The cylinder and the clamping device have mating surfaces which are textured to prevent relative movement between the device and the cylinder along the length of the borehole.

In accordance with another aspect of the present invention, a soil testing device insertable into a borehole, includes lateral clamps adapted to engage the internal wall. A pair of elements extending outwardly beyond said clamps, are adapted to center said clamp frame within said auger.

In accordance with yet another aspect of the present invention, a soil testing device includes an auger having an internal wall. A clamp frame is disposed within the auger. A pair of lateral clamps are longitudinally aligned and disposed exterior to the clamp frame, the lateral clamps adapted to engage the internal wall of the auger. A plurality of safety rods are attached to the clamp frame, extending outwardly from the clamp frame. The safety rods are adapted to control the lateral extension of the lateral clamps. A plurality of safety rod bumpers are attached to the safety rods, the bumpers arranged to prevent uncontrolled engagement of said lateral clamps with the auger. A plurality of clamp frame bumpers are attached to the clamp frame, the bumpers arranged to prevent uncontrolled engagement of the lateral clamps with the auger.

DESCRIPTION OF THE PREFERRED EMBODIMENTS

Figure 1:
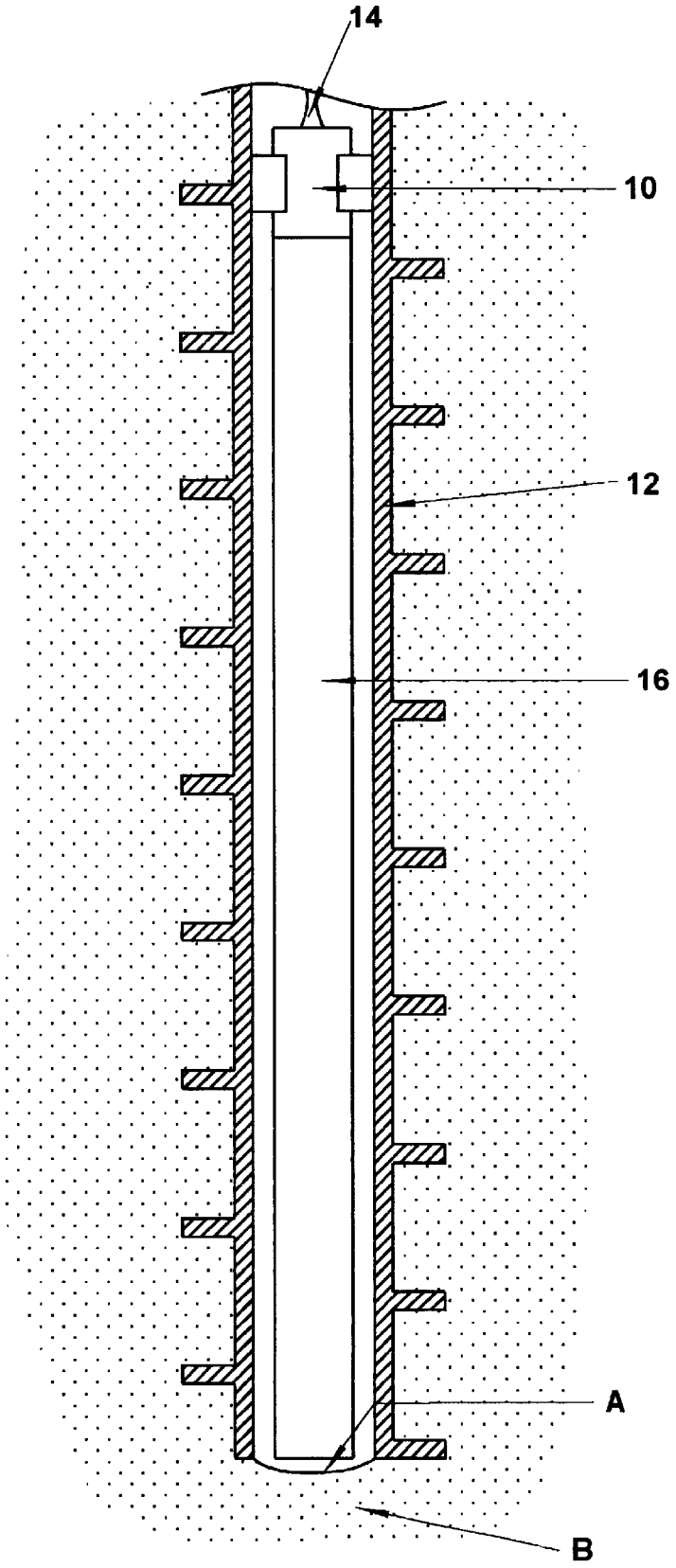
FIG. 1 is a partial sectional view of one embodiment of the present invention suspended within a borehole.

Referring to the drawing wherein like reference characters are used for like parts throughout the several views, a clamping assembly 10, shown in FIG. 1, is suspended in a cylindrical auger 12, in turn in position within a borehole "A". The clamping assembly 10 may be suspended on a line 14 from the surface. A soil testing device 16 is connected to the lateral clamping assembly 10. The soil testing device 16 could be of the type disclosed in U.S. Pat. Nos. 4,594,899 and 5,203,824, both of which are hereby expressly incorporated by reference herein. A soil test sample could be taken from the region "B" of the borehole "A" immediately below the auger 12.

The lateral clamping assembly 10 secures the soil testing device 16 in place near the bottom of the auger 12. The assembly 10 is used to prevent relative movement between the clamping assembly/associated attachments and the auger in a direction parallel to the longitudinal axis of the auger 12. Thus, the auger 12 may serve as a reaction means to support various operations involving a device 16 attached to the clamping assembly 10. For example, the system may be useful in connection with the penetration of a soil testing device 16 into the soil "B" and its subsequent rotation.

Figure 2:
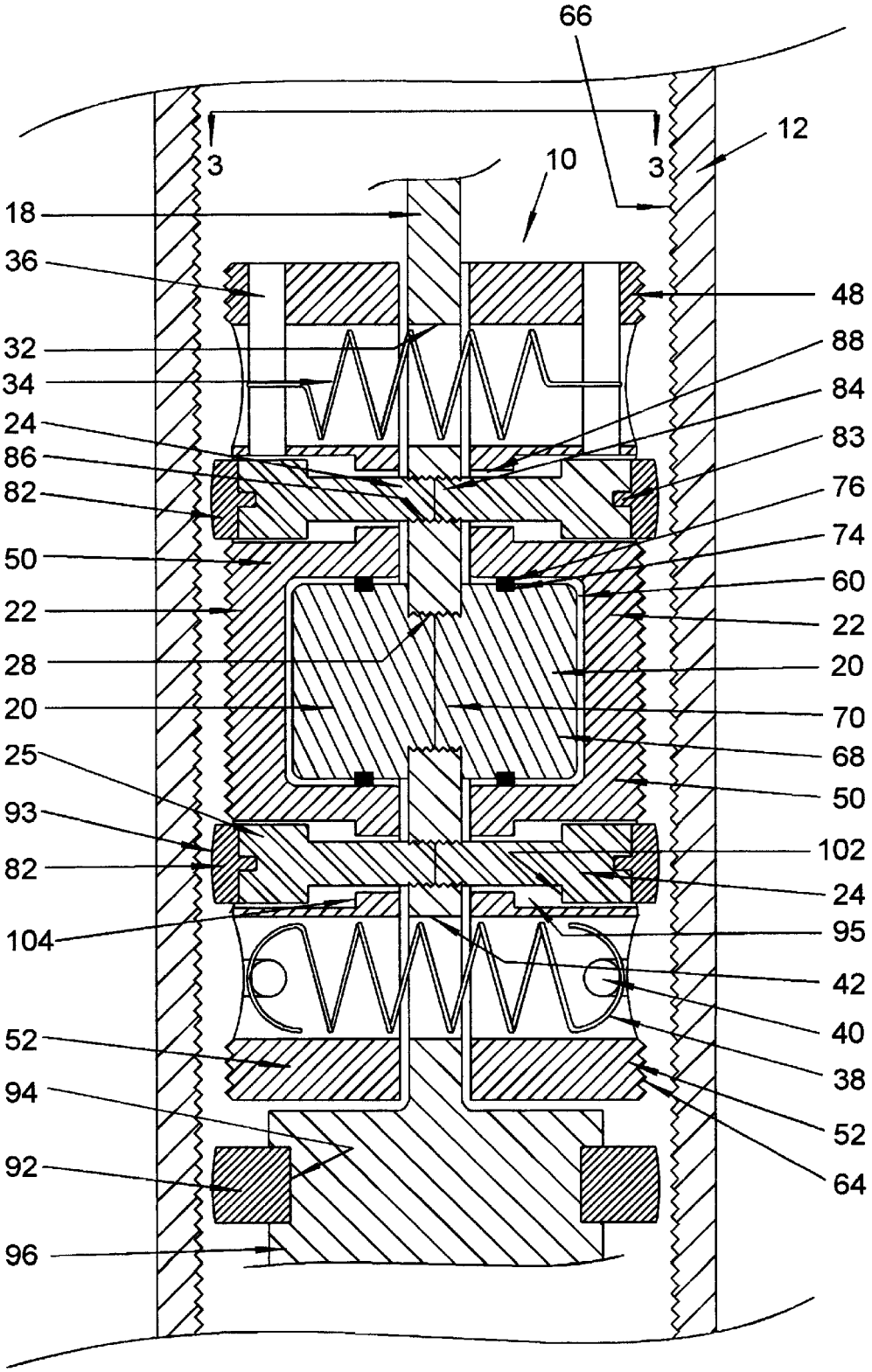
FIG. 2 is an enlarged, vertical cross-sectional view through the lateral clamping assembly shown in FIG. 1.

The clamping assembly 10 includes a clamp frame 18, a pair of slider bearings 20, a pair of lateral clamps 22 and safety rods 24, as shown in FIG. 2. The slider bearings 20 are threadly mounted on the clamp frame 18. The lateral clamps 22 are mounted on the slider bearings 20. The soil testing device 16 and other necessary attachments for soil testing may be attached to the frame 18 from below.

The lateral clamping assembly 10 is supported by the clamp frame 18 which connects to the line 14. The frame 18 extends through the center of assembly 10 and has an opening 28 which threadedly receives the bearings 20. The frame 18 also includes an opening 32 through which passes a transversely oriented coil spring 34 retained on studs 36. Likewise, the coil spring 38 is retained by pins 40 and extends transversely through an opening 42 in the frame 18.

Figure 3:
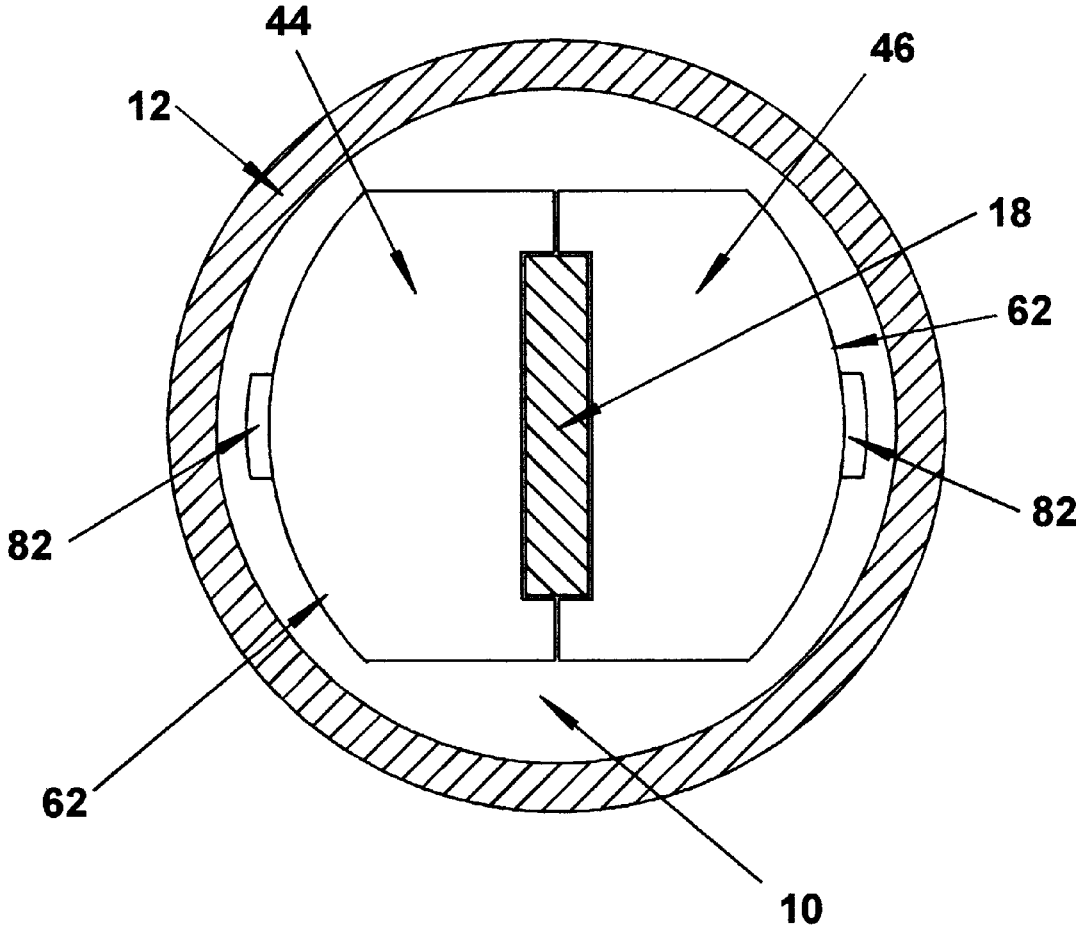
FIG. 3 is an enlarged cross-sectional view taken generally along the line 3—3 in FIG. 2.

The clamping assembly 10, located inside the auger 12, surrounds the clamp frame 18 and is made up of two generally cylindrical half sections 44 and 46, as shown in FIG. 3. The sections 44 and 46 are moveable laterally outwardly and inwardly with respect to the clamp frame 18. Referring to FIG. 2, the assembly 10 includes the upper sections 48, the lower sections 50 and the bottom sections 52, these sections being connected and moveable. In response to internal hydraulic pressure applied through a connection, not shown, to the space 60 between sections 50 and the slider bearings 20, sections 44 and 46 extend laterally outwardly, relative to one another, until they engage the inside surface of the auger 12. When the fluid pressure is released, the elements 44 and 46 return to the position shown in FIG. 3 due to the action of the springs 34 and 38. Of course, other mechanisms can be used to expand the assembly 10.

As shown in FIG. 3, the external wall 62 of the lateral clamping assembly 10 is generally cylindrically shaped to match the cylindrical internal auger 12 wall. The external wall 62 of the assembly 10 includes circumferential ribs 64 which mate with conforming ribs 66 on the internal wall of the auger 12. In this way, the mating ribs of the lateral clamps and auger interlock thereby providing resistance to slippage of the clamping assembly 10 when force or torque is supplied to a testing device 16 attached to the clamping assembly 10.

The ribs 66 on the internal wall of the auger 12 may extend vertically a distance greater than the vertical height of assembly 10. In this way, there is some freedom in positioning the clamping assembly 10 in the auger 12.

The mounting of lateral clamps 22 on the slider bearings 20 is shown in FIG. 2. As shown in FIG. 2, the slider bearing 20 has an unthreaded cylindrical part 68 and a threaded cylindrical part 70, the unthreaded cylindrical part 68 having a larger diameter than the threaded cylindrical part 70. The threaded cylindrical part 70 mates with threaded holes 28 in the clamp frame 18. On the unthreaded cylindrical part 68 of the slider bearing 20 is a slit 74 that runs along the circumference of the unthreaded cylindrical part 68. The slit 74 secures a lip seal 76 to the slider bearing 20. The seal 76 may be encased in a wear-resistant metal ring (not shown).

The lateral clamps 22 are slidably mounted on the slider bearings 20. The seal 76 prevents the assembly 10 from making direct contact with the slider bearing 20, thus allowing the assembly 10 to freely slide in the borehole in the transverse direction. The seals 76 on the slider bearings sealingly engage the lateral clamps 22 such that an oil enclosure 60 is defined.

Figure 4:
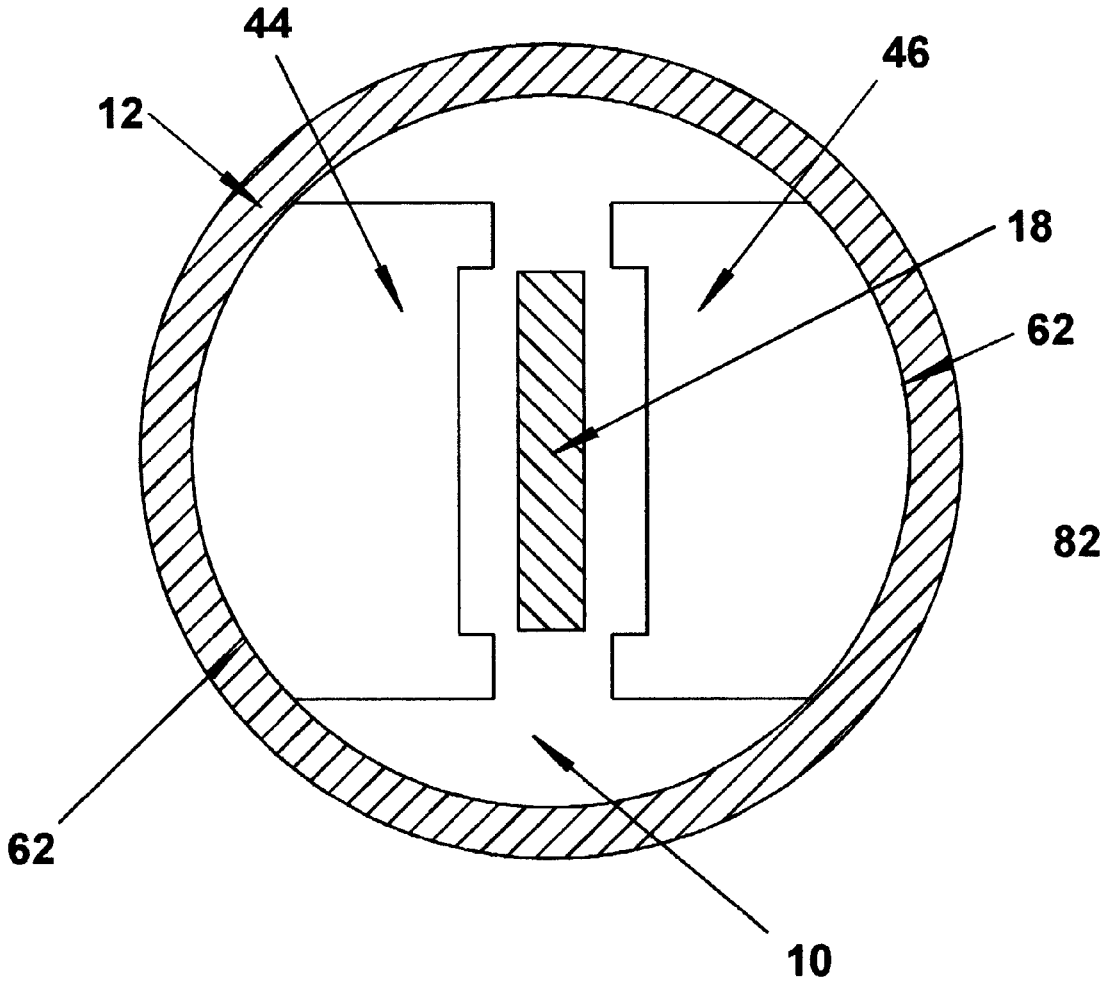
FIG. 4 corresponds to FIG. 3, but after the clamping assembly has been expanded.

The springs 34 and 38 maintain the sections 44 and 46 in the retracted position, shown in FIGS. 2 and 3, until an applied force overcomes the resistance of the springs 34 and 38, separating the sections 44 and 46 from the clamp frame 18, as shown in FIG. 4. The lateral clamps 22 may be released from the retracted position by hydraulic means which may include feeding pressurized fluid into the enclosure 60, for example. When the lateral clamps 22 are released from the retracted position, the lateral clamps 22 move away from the clamp frame 18 toward the internal wall of the auger 12. The lateral clamps 22 are in an extended position when the ribs 64 on the lateral clamps 22 interlock with the ribs 66 of the internal wall of the auger 12. Motion sensors (not shown) may be attached to the clamp assembly 10 to indicate when the lateral clamps should be released from the retracted position and allowed to engage the internal wall of the auger 12.

The lateral extension of the lateral clamps 22 is controlled by safety rods 24. As shown in FIG. 2, the safety rods 24 include safety rod bumpers 82 on one end and threaded portions 84 on the other end. The threaded portions 84 of the safety rods 24 mate with threaded holes 86 on the clamp frame 18. The safety rods 24 are connected to the clamp frame 18 via holes 88 in the lateral clamps 22. The holes 88 have similar shapes to the safety rods 24. In this way, the lateral clamps 22 move laterally past the rods 24 when sliding from the retracted position at the clamp frame 18 to the extended position at the internal wall of the auger 12.

The safety rod bumpers 82 may include a necked down, threaded portion 83 which threadedly engages the rest of the safety rod 24. The safety rods 24 are mounted in pairs on opposite sides of the clamp frame 18. The safety rod heads 25 are spaced from the clamps 22 in such a way that the lateral clamps 22 are prevented from extending too far outwardly. The abutting surfaces 102 and 104 contact to stop the outward extension of the clamps 22.

As shown in FIG. 2, safety rod bumpers 82, have a curved outward surface 93, and may be made of Delrin. The safety rod bumpers 82 extend outwardly from the lateral clamps 22 when the lateral clamps 22 are in the retracted position. In this way, the lateral clamps 22 are prevented from engaging the auger 12, for example, before the lateral clamps 22 are released to engage the internal wall of the auger 12. The safety rod bumpers 82 are hidden in the slots 95 in the lateral clamps 22 when the lateral clamps 22 have engaged the internal wall of the auger 12.

As shown in FIG. 2, clamp frame bumpers 92 are fitted to the channels 94 at the base 96 of the clamp frame 18. The clamp frame bumpers 92 assist in preventing the lateral clamps 22 from engaging the internal wall of the auger 12 in an uncontrolled manner. The bumper 92 may be made of Delrin as well.

The clamping assembly 10 is generally used to secure a soil testing device near the bottom of an auger 12 as follows. Initially, the lateral clamps 22 are at a retracted position, secured to the clamp frame 18. A soil testing device 16 is attached to the base 96 of the clamp frame 18. The clamping assembly 10 with the soil testing device is lowered by a wireline 14, or any other appropriate means, into an auger 12 in a borehole "A". The springs 34 and 38 maintain the lateral clamps in a retracted position as the clamping assembly 10 is lowered.

When the clamping assembly 10 is in position, the lateral clamps 22, which may be hydraulically actuated, are released from the retracted position, shown in FIG. 3, and allowed to move toward the internal wall of the auger 12, as shown in FIG. 4. The slider bearings 20 and the safety rods 24 control the movement of the lateral clamps 22 in a lateral direction. The lateral clamps 22 engage the internal wall of the auger 12 by interlocking the ribs 64 on its external wall with the ribs 66 on the internal wall of the auger 12. Substantial force can be applied to the clamping assembly 10 to ascertain that the lateral clamps 22 are fully engaged to the internal wall of the auger 12. When the clamp frame 18 is ready to be released, the extending mechanism is reversed and the springs 34 and 38 return the lateral clamps 22 to the retracted position, while the hydraulic pressure is released from the passage 60.

While the present invention has been described with respect to a preferred embodiment, those skilled in the art will appreciate numerous modifications and variations therefrom. The appended claims are intended to cover all such modifications and variations which occur to one of ordinary skill in the art.

What is claimed is:

1. A soil testing device insertable into a borehole, comprising:

a first external cylinder;

a soil testing device located inside said cylinder; and a clamping device connected to said soil testing device, said clamping device arranged to extend laterally outwardly to engage said cylinder, said cylinder and said clamping device having mating surfaces which are textured to prevent relative movement between said device and said cylinder along the length of the borehole, wherein the longitudinal extent of said textured, mating surface on said cylinder is greater than the longitudinal extent of said clamping device, said clamping device and said cylinder being configured such that said clamping device can engage said cylinder at a plurality of spaced apart locations along the length of said cylinder.

2. The device of claim 1, wherein said cylinder and said clamping element have mating circumferential ribs.

3. The device of claim 1, including a mechanism to laterally extend said clamping element to engage said cylinder.

4. A soil testing device insertable into a borehole, comprising:

a soil testing device;

a plurality of clamping devices adapted to releasably engage the borehole, wherein said clamping devices are laterally extendible and retractable; and an element extending outwardly beyond each clamping device when said clamping devices are not engaging said borehole wherein said element is arranged to control the amount of lateral extension of said clamping devices, said element including a metal shaft threadedly secured to a hard plastic bumper.

5. A soil testing device comprising:

a soil drilling device having an internal wall;

a soil testing device located in said soil drilling device;

a clamp frame attached to said soil testing device;

a plurality of clamping devices longitudinally aligned and disposed on the exterior to said clamp frame, said clamping devices adapted to releasably engage the internal wall of said drilling device;

a plurality of safety rods attached to said clamp frame and extending outwardly from said clamp frame, said safety rods adapted to control the lateral extension of said clamping devices; and a plurality of bumpers arranged to prevent uncontrolled engagement of said clamping devices with said soil drilling device.

6. The soil testing device of claim 5, wherein said bumpers extend outwardly from said clamping devices when said clamping devices are in a retracted position.

7. The soil testing device of claim 5, including a plurality of clamp frame bumpers attached to said clamp frame, said clamp frame bumpers arranged to prevent uncontrolled engagement of said clamping devices with said drilling device, wherein said clamp frame bumpers extend outwardly with respect to said clamping devices when said clamping devices are in a retracted position.

8. The soil testing device of claim 5, wherein said bumpers are disposed within said clamping devices when said clamping devices are extended to engage the internal wall of said soil drilling device.

9. The soil testing device of claim 7, wherein said clamp frame bumpers are disposed interior to said clamping devices when said clamping devices are extended to engage the internal wall of said drilling device.

10. A method of testing soil, comprising the steps of:

lowering a soil testing device into a lined borehole;

controlling the lateral position of said device using transversely oriented bumpers; and, extending clamping devices laterally outwardly to engage said liner borehole such that textured surfaces on said lined borehole and said clamping devices interlock.

11. The method of claim 10, including the step of using said bumpers to control the extent of outward extension of said clamping devices.

12. The method of claim 10, including the step of forming said lined borehole using an drilling device.

* * * * *